US005131837A

United States Patent [19]

Adams

[11] Patent Number: 5,131,837

[45] Date of Patent: Jul. 21, 1992

[54] BACKUP TRIAL FOR IGNITION TIMER

[75] Inventor: John T. Adams, Minneapolis, Minn.

[73] Assignee: Honeywell Inc., Minneapolis, Minn.

[21] Appl. No.: 584,827

[22] Filed: Sep. 19, 1990

[51] Int. Cl.[5] ..... F23N 5/20

[52] U.S. Cl. ..... 431/69; 431/78; 431/18; 431/75

[58] Field of Search ..... 431/1 B, 69, 73, 75, 431/77, 78, 79, 80; 340/577

[56] References Cited

U.S. PATENT DOCUMENTS 4,303,385 12/1981 Rudich,Jr. et al. ..... 431/78 X
4,507,702 3/1985 Grewe ..... 431/78 X
4,836,770 6/1989 Geary ..... 431/78 X

*Primary Examiner*—Carl D. Price
*Attorney, Agent, or Firm*—Robert B. Leonard

[57] ABSTRACT

A gas valve control system including a microprocessor, a first relay, a second relay, flame sensor and a timer. The timer is connected to the switch which is connected in the power supply path of the second relay. The second relay is connected to the valve. Activation of the first relay causes activation of the second relay causing the valve to open. Also, activation of the first relay causes the timer to operate. The flame sensors then must sense flame or else the microprocessor will deactivate the first relay. If the microprocessor fails to deactivate the first relay, the timer causes the switch to open and break the power supply path to the second relay. This in turn causes the valve to close.

5 Claims, 1 Drawing Sheet

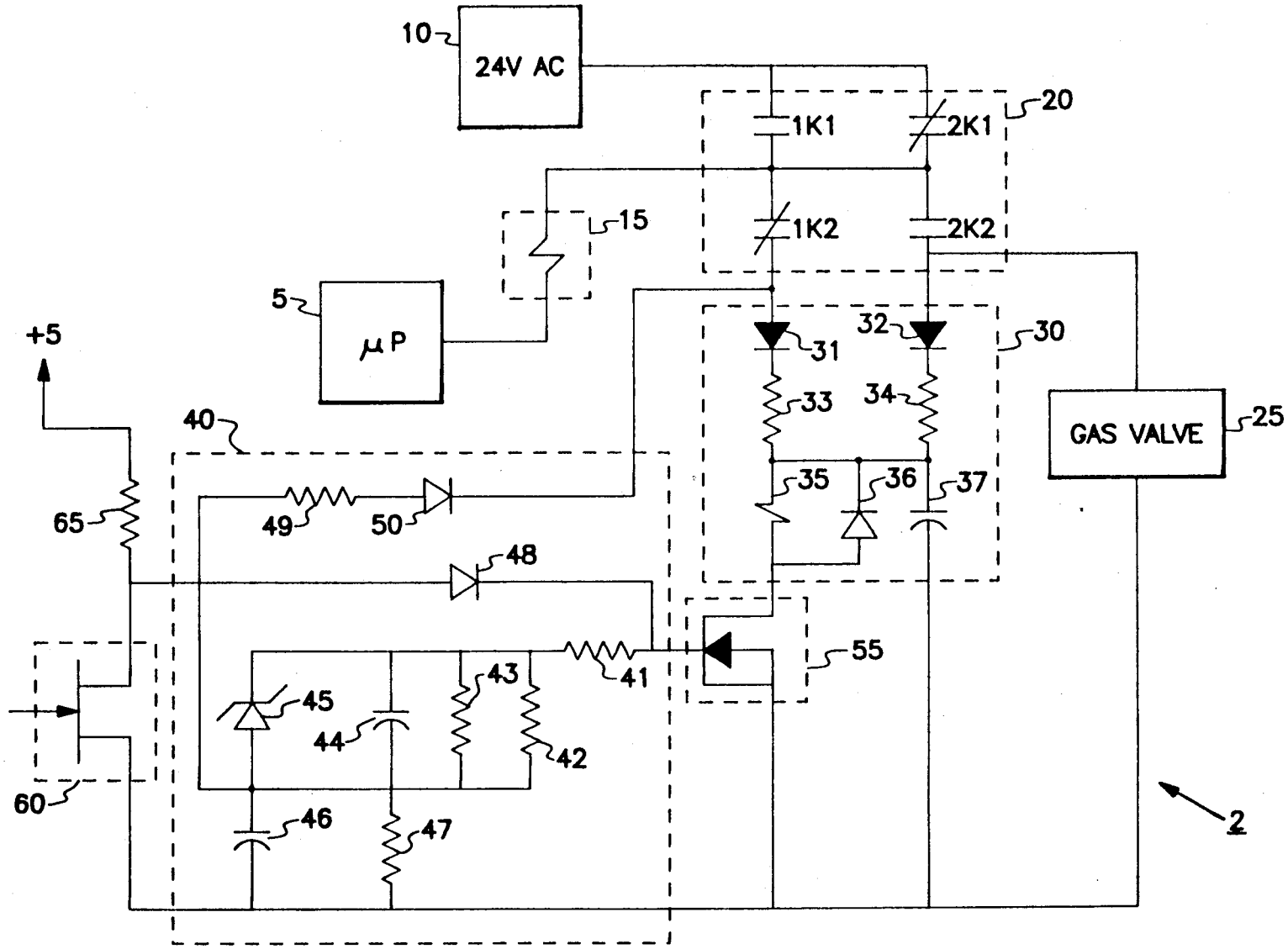
GAS VALVE
25
2
20
30
2K1
2K2
1K1
1K2
32
31
34
33
36
35
37
55
15
24V AC
10
μP
5
41
42
43
44
45
46
47
48
49
50
40
65
+5
60

BACKUP TRIAL FOR IGNITION TIMER

This invention relates generally to the field of furnace controls, and more specifically to controls for furnaces having gas valves.

Modern furnace systems generally included electrically operated valves (EOV's) to control the flow of a fuel into a combustion chamber. The EOV's were in turn controlled by relays which opened the EOV when the relay received an energization signal from a system microprocessor. The microprocessor was adapted to open and close the EOV at preselected times.

Unfortunately, the microprocessors occasionally failed and left the valve open. This meant that gas was released into the combustion chamber which created the potential for an explosion.

Thus, it is an object of the present invention to provide a fail safe furnace control in which a failure of the microprocessor does not leave the gas valve open.

SUMMARY OF THE INVENTION

The present invention is a system for insuring that a failure of the microprocessor does not leave the gas valve open indefinitely. The gas valve control system includes a microprocessor, first and second relays, flame sensing means, a switch and a timing means. The valve, first and second relays and safety circuit are powered from an external power supply. Activation of the first relay causes activation of the second relay which causes the valve to open. Deactivation of the first or second relay causes the valve to close. The flame sensing means is adapted to produce a first signal when flame is present in a combustion chamber of the furnace. The microprocessor is in contact with the first relay and said flame sensing means and activates the first relay thus activating the second relay and opening the valve when heat is requested by an external thermostat. The microprocessor deactivates the first relay thus deactivating the second relay and closing the valve after a first predetermined time if the first signal is not received from said flame sensing means. The timing means is connected to the switch which in turn is connected to the second relay. The flame sensing means and the timing means are connected and open the switch thus deactivating the second relay after a second predetermined time period if the first signal is not received from the flame sensing means and if the second relay has not already been deactivated by the microprocessor.

BRIEF DESCRIPTION OF THE DRAWING

The FIGURE is a block-schematic diagram of one preferred embodiment of the present invention.

DETAILED DESCRIPTION OF THE PREFERRED EMBODIMENT

Referring now to the FIGURE, thereshown is a preferred embodiment of the present invention. Gas valve control system 2 comprises microprocessor 5, power supply 10, 1K relay drive 15, relay contacts 20, gas valve 25, 2K relay drive means 30, timing means 40, switch 55 and flame sensing means 60. Generally, such a system is used in a furnace to control the release of gas into a combustion chamber within the furnace.

microprocessor 5 controls the operation of the system 2. The microprocessor receives inputs from an external thermostat (not shown) and is programmed to initiate valve opening at desired times.

1K relay drive 15 is electrically connected to the microprocessor 5. When the microprocessor determines that the gas valve 25 is to be opened, it sends a signal to the 1K relay drive which causes the 1K relay to activate.

Activation of the 1K relay causes relay contact 1K1 to close and contact 1K2 to open. Opening of the 1K2 contact in turn causes the 2K drive means 30 to open contact 2K1 to open and to close contact 2K2. By closing contact 2K2, power is supplied to gas valve 25.

There are times when it is desirable to close the gas valve, such as: (1) when a predetermined temperature is measured by a thermostat (not shown); or (2) when the gas being released does not ignite but instead builds in the combustion chamber. The thermostat generally will close the valve in the first situation.

In the second situation, using a prior art system, the flame sensing means would identify to the microprocessor that no flame was present in the combustion chamber. The microprocessor controlled the initiation of flame and kept the valve open for a predetermined amount of time as long as flame was sensed. Yet failure of the microprocessor could lead to the gas valve being left open without a flame being present. If no flame were present, leaving the gas valve open could be disastrous.

Thus, in the present embodiment, the microprocessor is connected so that it can open the valve at any time there is a call for heat, and it can close the valve at any time, but the microprocessor cannot keep the valve open.

In order to control the opening and closing of the valve, a switch 55 is included in a power supply path of the 2K drive means 30. Once again, activation of the 2K drive means 30 opens the gas valve while deactivation closes the valve. Switch 55 is adapted to deactivate the 2K drive means 30 by breaking its power supply path.

Two controls are connected to switch 55: timing means 40 and flame sensing means 60. The timing means and the flame sensing means cooperate to control when the valve is deactivated. The timing means is redundant with timing functions performed by the microprocessor. The microprocessor can cause the gas valve to close at any time. However, if the microprocessor fails, the timing means then in part determines the length of time the valve remains open.

The timing means will cause switch 55 to break the power supply path to the 2K relay drive means after a predetermined time from activation, if no signal is received by the switch from the flame sensing means. By having the timing means in the system, failure by the microprocessor to close the valve when necessary will not result in an explosion.

The timing means 40 can be constructed in many ways. A preferred embodiment includes resistors 41, 42, 43, 47 and 49, capacitors 44 and 46, zener diode 45 and diodes 50 and 48. Resistor 41 is connected in series with the gate of N channel enhancement TMOS FET transistor that comprises switch 55. Note that many other devices would serve equally as well as the switch chosen for this embodiment. Next, resistors 42 and 43 as well as capacitor 44 and zener diode 45 are connected in parallel together and then connected in series with resistor 41. The cathode of zener diode 45 is connected with resistor 41 while the anode of capacitor 44 is also connected to resistor 41. In parallel with resistors 42 and 43 capacitor 44 and zener diode 45 are resistor 47 and capacitor 46. The anode of capacitor 46 is connected to the anode of zener diode 45. The cathode of capacitor 46 and a second end of resistor 47 are connected to the power supply return line. Resistor 49 is connected to the anode of zener diode 45 while the anode of diode 50 is connected to resistor 49. Capacitor 44 and resistors 42 and 43 are selected so that a charge is maintained upon capacitor 44 for a predetermined amount of time. The method of calculating capacitance value for a capacitor 44 and resistance values for resistors 43 and 42 from a predetermined time constant is well known in the art.

Flame sensing means 60 is comprised of an N channel JFET connected to flame sensing rods (not shown). When flame is sensed by one of the flame sensing rods, the JFET is turned off and stops sinking current from the DC power supply to ground.

The transistor that comprises switch 55 requires a predetermined threshold voltage from gate to source before current will flow from the drain to the source. Thus, in order for the 2K relay drive means 30 to operate, a gate to source voltage equal to the threshold voltage of the transistor must be maintained. When $V_{GS}$ drops below $V_T$ the power supply path for the 2K relay drive means is cut thus deenergizing the means enclosing the gas valve.

The 2K relay drive means 30 is comprised of diodes 31 and 32, resistors 33 and 34, 2K relay drive 35, diode 36 and capacitor 37. The anode of diode 31 is connected to contact 1K while the cathode of diode 31 is connected to a first end of resistor 33. The anode of diode 32 is connected to contact 2K2 while its cathode is connected to a first end of resistor 34. Second ends of resistors 33 and 34 are connected together. 2K relay drive 35 and diode 36 are connected in parallel to the junction of resistors 33 and 34. The cathode of diode 36 is connected to the junction of resistors 33 and 34 while the anode of diode 36 is connected to the gate of the enhancement type TMOSFET transistor. The anode of capacitor 37 is connected to the junction of resistors 33 and 34 while the cathode is connected to the power supply return line.

A more detailed description of the operation of the system will now be provided. To insure that the microprocessor cannot fail unsafe and leave the gas valves open, a backup timer has been incorporated in the relay drive circuit. The philosophy of the design is to allow the microprocessor to start a trial for ignition and to stop a trial at any time. However, the microprocessor cannot keep the valve open. The only means to keep relay 2K powered is if flame is sensed by flame sensing means 60 and the N channel depletion JFET transistor is thereby pinched off. This allows current to flow through resistor 65, diode 48 to the gate of the N channel enhancement TMOSFET transistor. In the event that flame is not sensed and the microprocessor fails to drop power to the 1K relay, the backup timer will insure that the drive to the TMOSFET transistor goes away and causes the 2K relay to deactivate. The backup timer is armed when current flows through resistor 47, resistor 49 and diode 50. This brings capacitor 46 negative with respect to ground. At the same time current flows through resistor 65, diode 48, resistor 41, capacitor 44, resistor 49 and diode 50. This puts 15 volts across capacitor 44. The backup timer has a seven second time constant with the chosen values for resistances 42 and 43 and capacitor 44. Capacitor 46 and resistor 47 are used to filter out the 60 hz halfwave signal as produced because of diode 50. Thus, as long relays 1K and 2K are in the relaxed state, capacitor 46 will charge to −30 volts and capacitor 44 will then be 15 volts below ground. Capacitor 46 also acts as a low voltage monitor. If the voltage from the AC power supply is not large enough, capacitor 46 will not charge sufficiently negatively so that switch 55 will be turned on during the positive half cycle of the power supply. This in turn prevents capacitor 37 from charging sufficiently to provide the needed charge to activate the 2K drive 35. When the 1K relay energizes, capacitor 46 will discharge quickly through resistor 47 thus putting a positive 15 volts from capacitor 44 at the gate of the TMOSFET transistor quickly. It is essential that this voltage be applied to the gate of the TMOSFET transistor quickly so it turns on fast thus dumping the stored charge on capacitor 37 into the 2K relay drive which starts the trial for ignition.

The foregoing has been a description of a novel and nonobvious backup trial for ignition timer. The applicant does not intend to be limited to the embodiments contained herein, but instead defines his invention by the claims appended hereto.

I claim:

1. A valve safety circuit for a furnace having a valve which opens and closes, and a combustion chamber, comprising:

flame sensing means adapted to produce a first signal if flame is present in the combustion chamber;

a first relay;

a second relay which is connected to said valve and said first relay;

first timing means connected to the first and second relay, said first timing means opening the valve, and closing the valve a first predetermined time period after the valve has been opened;

second timing means connected to the second relay, said second timing means closing the valve a second predetermined time period after the valve has opened; and a switch connected to said flame sensing means and said first and second timing means, said switch preventing said first and second timing means from closing the valve while said switch receives said first signal.

2. The valve safety circuit of claim 1, wherein said first timing means is comprised of a microprocessor programmed to open and close the valve at predetermined times.

3. The valve safety circuit of claim 2, wherein said second timing means is an RC circuit having a time constant equal to said second predetermined time, said second predetermined time being longer than said first predetermined time.

4. The valve safety of claim 3, wherein said second timing means is comprised of resistors and a capacitor all electrically connected in parallel.

5. The valve safety circuit of claim 3 wherein said switch is comprised of an enhancement mode MOSFET.

* * * * *